United States Patent [19]

Imbiel et al.

[11] Patent Number: 4,498,087

[45] Date of Patent: Feb. 5, 1985

[54] APPARATUS FOR UNFOLDING AN ANTENNA NETTING REFLECTOR

[75] Inventors: Herbert Imbiel, Haar; Henning Herbig, Holzkirchen, both of Fed. Rep. of Germany

[73] Assignee: Messerschmitt-Boelkow-Blohm Gesellschaft mit beschraenkter Haftung, Munich, Fed. Rep. of Germany

[21] Appl. No.: 387,547

[22] Filed: Jun. 11, 1982

[30] Foreign Application Priority Data

Jun. 25, 1981 [DE] Fed. Rep. of Germany ..... 3124907

[51] Int. Cl.[3] ..... H01Q 15/20

[52] U.S. Cl. ..... 343/915

[58] Field of Search ..... 343/880, 840, 915, 881

[56] References Cited

U.S. PATENT DOCUMENTS

| | | | |
|---|---|---|---|
| 2,535,049 | 12/1950 | De Rosa | 343/880 |
| 3,286,270 | 12/1966 | Kelly | 343/840 |
| 3,406,404 | 12/1968 | Maier | 343/915 |
| 3,541,569 | 11/1970 | Berks et al. | 343/915 |
| 3,566,346 | 2/1971 | Scopatz | 343/881 |
| 3,576,566 | 4/1971 | Cover, Jr. et al. | 343/881 |
| 4,030,102 | 6/1977 | Kaplan et al. | 343/915 |
| 4,030,103 | 6/1977 | Campbell | 343/915 |
| 4,352,113 | 9/1982 | Labruyere | 343/915 |

OTHER PUBLICATIONS

"Zeitschrift fuer Flugwissenschaft und Weltraumforschung"; No. 4, 1980, vol. 5, pp. 255 to 267.

*Primary Examiner*—Eli Lieberman
*Assistant Examiner*—K. Ohralik
*Attorney, Agent, or Firm*—W. G. Fasse; D. H. Kane, Jr.

[57] ABSTRACT

An unfoldable antenna netting reflector includes a plurality of stiff ribs to which the reflector net is secured. These stiff ribs are pivoted to a central holding member and extend radially outwardly when the reflector is unfolded to spread out the reflector netting. In order to assure a trouble-free unfolding of such a reflector at any time levers (8, 9) are provided between two ribs each (2, 4; 4, 6). Tensioning cables (14, 16) running over rollers (17, 19) are operatively connected to the buckling joints (8',9') of these levers for straightening out the levers. The ends of the levers are pivoted to the respective rib and the levers are capable of buckling in but one direction. When the levers assume the stretched out position, they snap into a locked condition. A plurality of ropes arranged for operating a plurality of levers may be operated in unison. The levers are secured to the ribs either at a spacing from the radially outer end of the ribs, or they may be secured to these radially outer rib ends.

14 Claims, 4 Drawing Figures

APPARATUS FOR UNFOLDING AN ANTENNA NETTING REFLECTOR

CLAIM TO PRIORITY

The present application is based on German Ser. No. P 31 24 907.8, filed in the Federal Republic of Germany on June 25, 1981. The priority of the German filing date is claimed for the present application.

BACKGROUND OF THE INVENTION

The present invention relates to an apparatus for unfolding an antenna netting reflector. Such reflectors comprise stiff ribs which are pivotally supported and which extend radially outwardly from a center in the unfolded condition of the antenna netting reflector. The netting of the reflector is secured to the ribs and suspended between the ribs.

Such antenna reflectors are primarily used in space travel because it is essential in space vehicles that the payload is as large as possible having regard to the limited transport volume. Thus, these antennas are initially folded when the space vehicle travels towards its intended orbit. Only when the intended orbit has been reached, will the antenna be unfolded. Several different constructions are known in the art for such folding antennas. These prior art structures comprise various types of unfolding mechanisms adapted to particular requirements, see for example the publication "Zeitschrift fuer Flugwissenschaft und Weltraumforschung", Number 4, 1980, Volume 5, pages 255 to 267. A so-called "offset" reflector is disclosed in this reference among others. Such reflector may be unfolded and has the above mentioned features. The unfolding takes place in two sequential phases. In the first unfolding phase flexible cross connectors are effective which are secured between the rib ends. These flexible cross connectors are kept under tension during the folded condition of the reflector. When these flexible cross connectors are released they start the unfolding of the reflector by spreading the radial ribs. The full unfolding takes place in the second phase which also provides for a locking in the unfolded position. Such locking is necessary to assure a defined surface configuration of the reflector netting. Such locking requires an additional drive means because during or along the last portion of the unfolding displacement a counteraction is required for opposing the increasing tension in the reflector netting. The prior art structure provides for this purpose an adjustment motor which operates block and tackle means. However, the structural details of such block and tackle means are not described in the above mentioned reference.

The flexible cross connectors which are secured to the rib ends in the prior art reflector construction are exposed to extraordinarily high mechanical tensions, especially when the ribs are in their folded condition resting closely next to one another. Moreover, during the starting or launching of a space vehicle, vibrational energy is introduced into the reflector structure which must be taken up additionally by said cross connectors. These extraordinarily high loads are a source of trouble or danger because they may cause one or the other cross connectors to break even before the unfolding operation begins, whereby a proper unfolding is not assured anymore.

OBJECTS OF THE INVENTION

In view of the above it is the aim of the invention to achieve the following objects singly or in combination:

to construct an unfoldable antenna netting reflector in such a manner that it is capable of handling high mechanical loads while nevertheless assuring a proper unfolding at any time;

to avoid two separate unfolding phases by assuring a proper unfolding in one sequence;

to assure the required locking in the unfolded condition;

to make sure that the entire reflector netting is uniformly unfolded so that the desired unfolded shape is obtained; and to keep the ribs, even in the folded condition, as far apart as possible so as to make the unfolding as easy as possible while simultaneously efficiently using the available space.

SUMMARY OF THE INVENTION

The unfoldable netting antenna reflector according to the invention comprises at least one lever which connects two adjacent ribs at its two ends. Each lever has two sections capable of buckling in but one direction and locking into a stretched out position when it is in the unfolded condition. Cables forming a block and tackle arrangement are secured to the knuckle or knee joint of the lever sections.

This type of construction according to the invention makes sure that the unfolding operation takes place in a single sequence by the actuation of the cables which are arranged to be effective on the levers buckled substantially radially outwardly in the folded condition, but are substantially radially inwardly effective under the influence of the cables when the cables pull the levers into a stretched out position in which the levers are locked. This type of arrangement makes sure that the unfolding proceeds without any trouble and that the required locking takes place automatically at the end of the unfolding. In their folded condition the levers are not subject to any load and are thus able without any difficulties to withstand the loads that may occur during the transport of these antennas.

The arrangement of the block and tackle means may be such that the cables which cooperate with a plurality of levers are operable in unison. This feature makes sure that the entire reflector may be unfolded uniformly so that localized tension loads in the reflector netting are avoided. The levers which are essential for the unfolding operation are preferably secured to the ribs with a spacing from the radially outer rib ends. Thus, it is possible to make these levers shorter than would be necessary if they are secured to the radially outer rib ends. Additionally, spacing the levers from the radially outer end of the ribs has the advantage that the angle between the two arms of the lever in their folded condition is larger which facilitates the beginning of the unfolding operation. The unfolding, especially the beginning of the unfolding, is also facilitated by providing spacers between the ribs so that the ribs cannot contact each other in the folded condition. The larger the initial spacing is between the ribs, the larger the lever angle will become so that the initiation of the unfolding operation becomes ever easier.

In order to provide a reflector structure which is especially stable or rugged in its unfolded and locked state, the rib ends are also interconnected by levers which lock into position when they are stretched out and which are capable of knuckling or folding only in one direction. These levers at the outer ends of the ribs may additionally be employed for facilitating or supporting the unfolding operation. This may be accomplished in a manner similar to that of the lever switch as spaced from the rib ends. For this purpose the knee or knuckle joints of the levers interconnecting the rib ends are also connected to cables of respective block and tackle systems.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
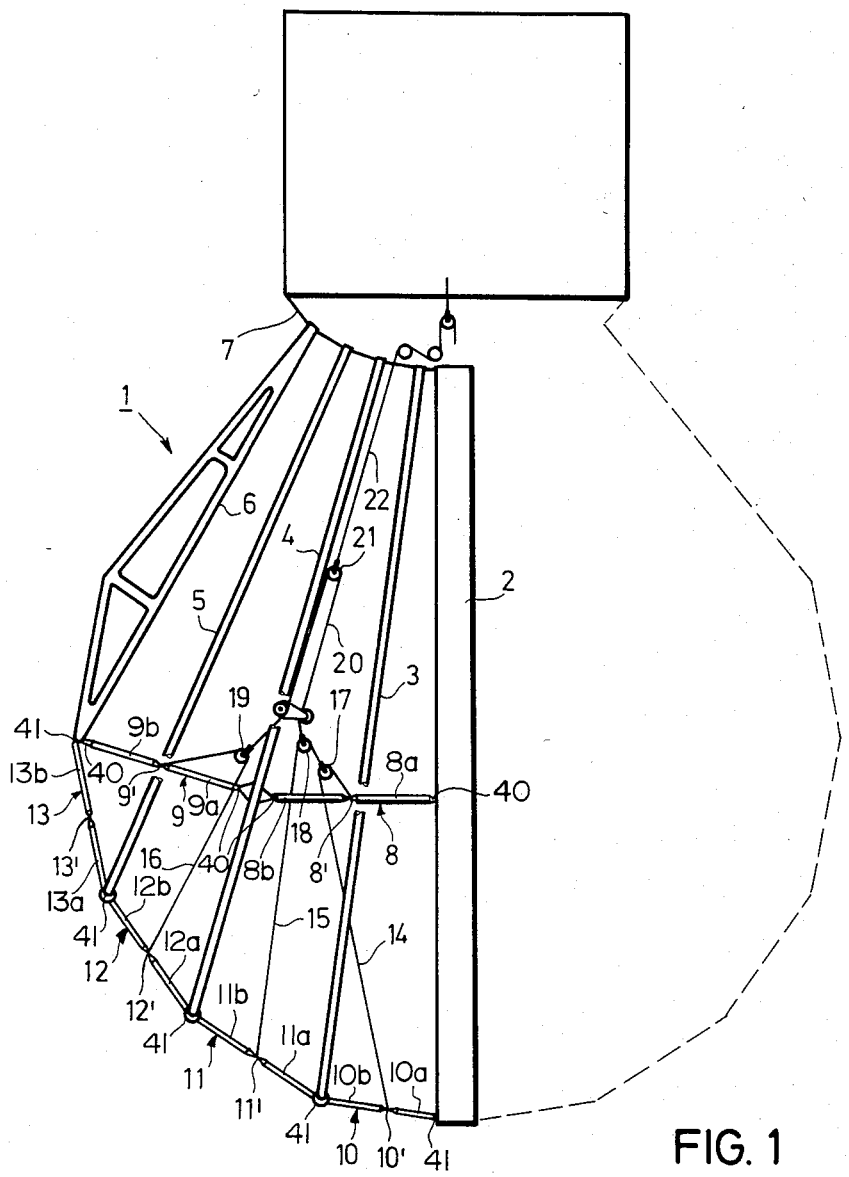
FIG. 1 illustrates an antenna netting reflector according to the invention in its unfolded state.

FIG. 1 illustrates schematically an antenna netting reflector 1 whereby only the left-hand half is shown in detail. The right-hand half is a mirrorsymmetrical image of the left-hand half. The reflector 1 comprises substantially a central rib 2 and a plurality of lateral ribs 3, 4 and 5, as well as outer ribs 6. The lateral ribs 3, 4 and 5 are arranged symmetrically on both sides of the central rib 2. For example, three lateral ribs 3, 4 and 5 may be used and one end rib 6 on each side. The ribs 2 to 5 are reinforced in the manner of a truss framework extending perpendicularly to the plane of the drawing substantially in the form of a two-dimensional frame work. The outer ribs 6 are also reinforced by a truss framework, however, in the form of a three-dimensional truss framework. The ribs are all secured to a central holding block 7 from which the ribs extend radially outwardly. The ribs 3 to 6 are pivoted to the holding block 7 and are preferably made of fiber reinforced synthetic material such as carbon fibers embedded in a resin matrix. Thus, these ribs are rather lightweight, yet they have a substantial strength.

A first and second inner lever 8 or 9 is provided between the ribs 2, 4 and 6. The lever 8 comprises two sections 8*a* and 8*b* forming a pair. The lever 9 comprises two sections 9*a* and 9*b* also forming a pair. The outer ends of the lever sections are connected by conventional pivots or journals 40 to the respective ribs 2, 4, 6. The inner ends of the sections 8*a*, 8*b*; 9*a*, 9*b* are connected to each other in pairs by conventional knee joints 8′, 9′ also referred to as knuckling or buckling joints 8′ and 9′ which take up a locked position when the levers 8 and 9 are in the stretched out position illustrated in FIG. 1. However, these knee joints or buckling joints 8′, 9′ may buckle radially outwardly. These knee joints as such are conventional machine elements. The radially outer end of the ribs 2 to 6 are interconnected by further outer levers 10, 11, 12 and 13 each also having two sections 10*a*, 10*b*; 11*a*, 11*b*; 12*a*, 12*b*; and 13*a*, 13*b*. These outer levers are also locked in the stretched out position and may be buckled radially outwardly by means of their conventional buckling joints 10′, 11′, 12′, and 13′ interconnecting their lever sections.

The outer ends of the lever sections 10*a* to 13*b* are pivotally connected by conventional pivots or journals 41 to the respective rib.

A total of three cables 14, 15 and 16 are operatively secured to the buckling joints 8′ to 12′ of the levers 8 to 12. The first cable 14 runs over a first compensating roller or sheave 17. The second cable 15 runs over a second compensating roller or sheave 18 and the third cable 16 runs over a third compensating roller or sheave 19. A fourth cable 20 is operatively secured to the compensating rollers 18 and 19. The fourth cable 20 runs over a fourth compensating roller or sheave 21 which in turn is operatively connected to a pulling cable 22 which may be subjected to a substantially radially inwardly directed tension force or pull which may, for example, be exerted by a power drive such as an electric motor. Additional guide rollers not provided specifically with reference numbers are located to guide the cables. The function of these guide rollers is quite clear from FIG. 2.

In the top plan view illustration the ribs appear to be straight. However, in reality the ribs 2 to 6 have a parabolic bend in a direction perpendicularly to the plane of the drawing for defining in a first approximation a parabolic reflector surface. A metallic netting, not shown, forming the reflector net is secured to the ribs. The netting is of a fine mesh type as is conventional. A second net of a larger mesh size may, for example, be arranged below the first netting for the purpose of adjustment by means of cross wires operatively and adjustably interconnecting both nettings, whereby a close approximation of a parabolically shaped configuration may be achieved.

Figure 2:
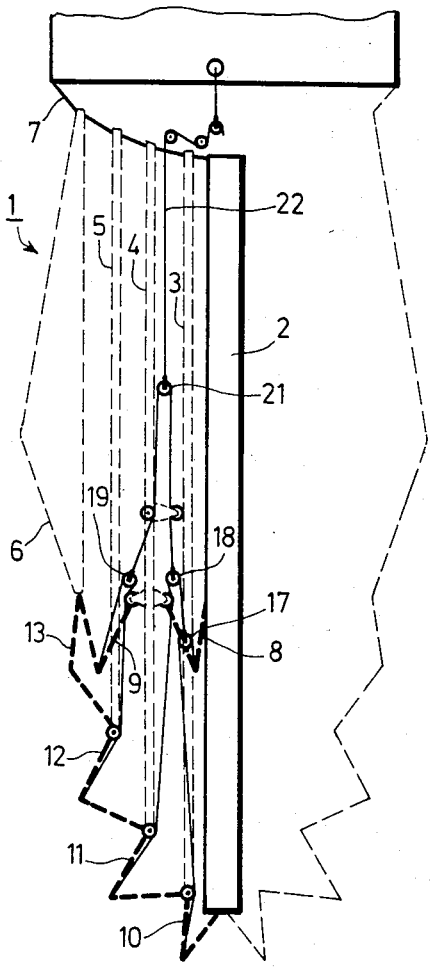
FIG. 2 shows the reflector according to FIG. 1 in the folded condition.

The same structural components are provided in FIG. 2 with the same reference numbers as in FIG. 1. To further simplify the illustration the ribs 3 to 6 in FIG. 2 are shown by thin dashed lines, whereas the levers 8 to 13 are shown by thick dashed lines to provide a clearer overview. As shown, the ribs in FIG. 2 are not contacting each other in the folded condition since they are spaced from another by spacers not shown, keeping these ribs at a predetermined spacing from one another in the folded condition. Thus, the two inner levers 8 and 9 are not completely folded. This has the advantage that due to the angle enclosed by the lever arms of the levers, the unfolding operation may be easily started. The unfolding operation may be started, for example in that with the aid of the pull cable 22 a pulling force is exerted on the compensating roller or sheave 21 which pulling force extends substantially radially inwardly. This pulling force is transmitted to the compensating rollers 18 and 19, as well as 17 so that eventually a force is applied to the knuckling joints of the inner as well as of the outer levers 8 and 9 or 10 to 12 which force brings these levers into the stretched out position shown in FIG. 1. Simultaneously with the stretching of the levers the ribs are spread apart until the respective levers snap into a locked position in their fully out-stretched condition, whereby the entire reflector structure is locked in the unfolded condition. Thus, the reflector takes up the unfolded state as shown in FIG. 1.

Figure 4:
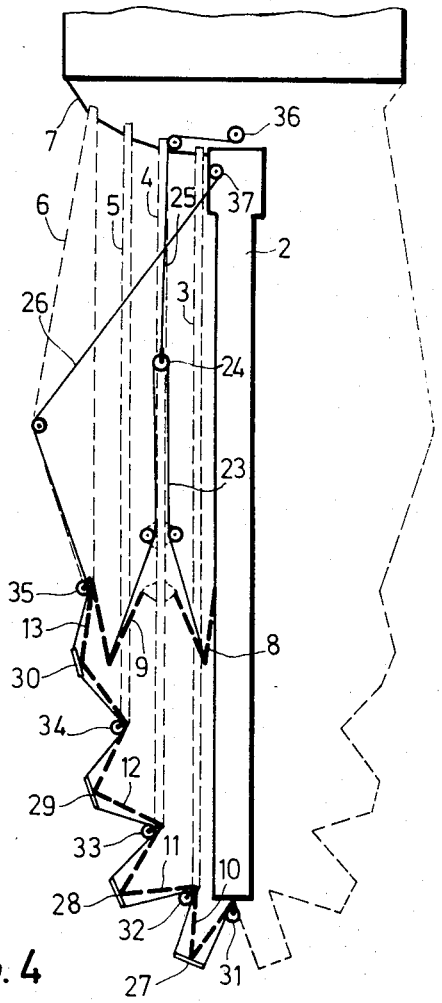
FIG. 4, illustrates the reflector of FIG. 3 in its folded condition.
Figure 3:
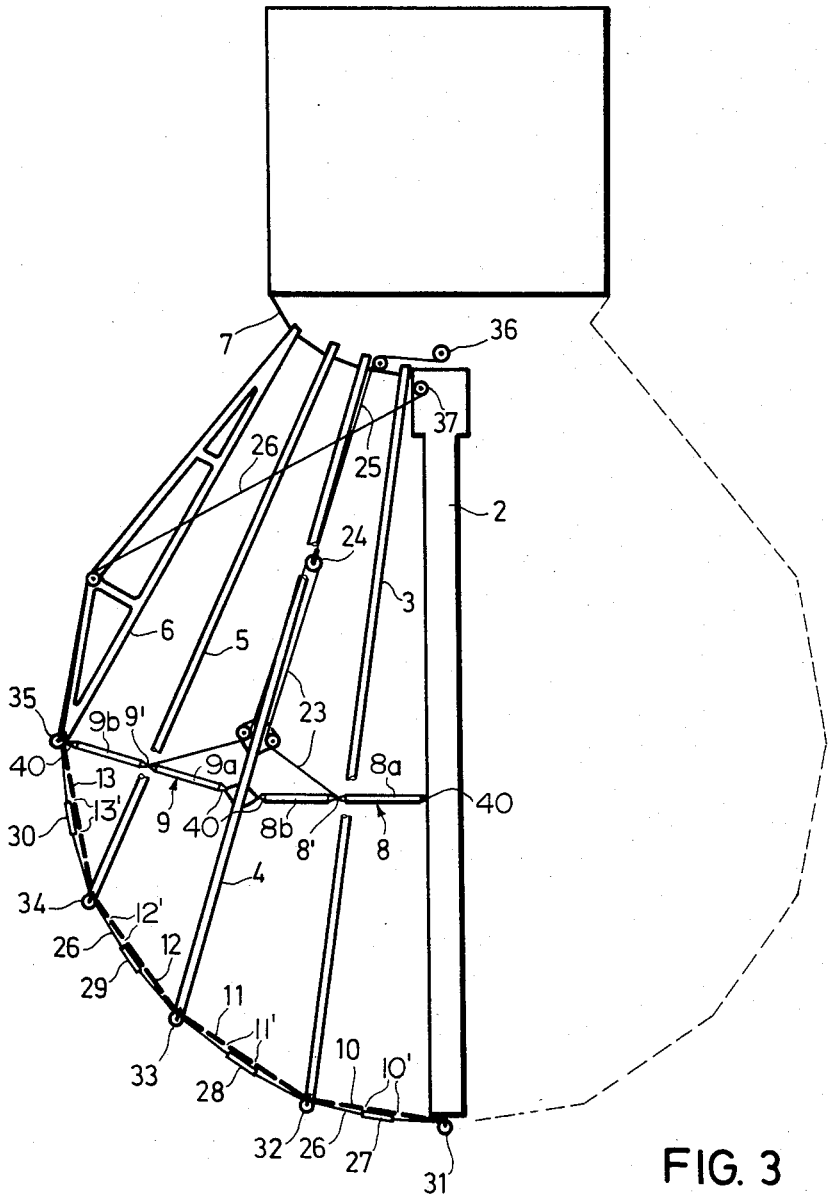
FIG. 3 illustrates a further example embodiment of an antenna netting reflector according to the invention in the unfolded state.

The number and type of ribs shown in the example embodiment of FIGS. 3 and 4 correspond to those in FIGS. 1 and 2. Thus, the same reference numbers are used in FIGS. 3 and 4. The same applies to the inner and outer levers 8 and 9, or 10 to 13. The arrangement in FIGS. 3 and 4 differs from that of FIGS. 1 and 2 primarily in that the pulling force is applied to the inner levers only through one cable 23 connected to the respective knuckle joints 8' or 9'. The cable 23 runs over a compensating roller or sheath 24 and cooperates with a pulling cable 25 for exerting said pulling force.

The outer levers 10, 11 and 12 shown with heavy dashed lines are not actuated by a pull effective radially inwardly, but rather by a tensioning cable 26 which is peripherally arranged. Cable guides 27 to 30 are provided at the buckling joints of the outer levers 10 to 13 for the peripherally arranged tensioning cable 26. The cable guides 27 to 30 may be provided, for example in the form of hollow rails equipped with guide grooves which guide the tensioning cable 26 radially outwardly. Additionally, guide rollers 31 to 35 are pivoted to the radially outer ends of the ribs 2 to 6. These guide rollers 31 to 35 guide the tensioning cable 26 in the radially inward direction. The tension or pulling cables 25 and 26 may, for example, be subjected to tension by means of a motor drive winding apparatus 36 and 37. The details of such a winding apparatus are not essential. These winding devices are actuated if it is intended to bring the reflector from the folded condition shown in FIG. 4 into the unfolded and locked condition shown in FIG. 3.

The illustration in FIG. 4 corresponds to that in FIG. 2, while the reference numbers correspond to that of FIG. 3 as mentioned. In order to unfold the reflectors a pull is simultaneously applied to both tensioning or pulling ropes 25 and 26. However, it would actually be sufficient to bring the levers 8 and 9 into the straightened out position merely by actuating the tensioning cable 25. Further, the unfolding operation is facilitated and accelerated by the additional actuation or tensioning of the tension cable 26.

The compensating rollers 21 and 24 as well as 17, 18 and 19 shown in FIGS. 1 to 4, make sure that the tension applied on the tension cables 22 or 25 are transmitted uniformly to the buckling joints of the respective levers so that the unfolding operation also takes place as uniformly as possible to avoid any jamming.

Both example embodiments shown in the drawings represent reflectors of the so-called "offset type". However, the invention is not limited to this type of reflector. Rather, the invention is applicable without any problems to reflectors of the centrally symmetric type.

Although the invention has been described with reference to specific example embodiments, it will be understood, that it is intended to cover all modifications and equivalents within the scope of the appended claims.

What is claimed is:

1. An apparatus for unfolding an antenna reflector which is initially in a folded condition, comprising support means (7), a plurality of ribs pivoted to said support means and extending substantially radially outwardly from said support means, lever means (8, 9) each having two lever sections forming a pair and a respective buckling joint (8', 9') operatively interconnecting said lever sections at one end of each lever section for unfolding the corresponding lever means in but one direction, said buckling joints snapping into a locked position when the respective lever means is in a fully stretched out position, pivot means operatively connecting the other end of each lever section to a respective one of said ribs so that two ribs interconnected by a pair of lever sections also form a pair (2, 4; 4, 6) of ribs, block and tackle means including cables (14, 16) and sheaves (17, 19) for guiding said cables, and means operatively connecting said cables to said buckling joints (8', 9') for applying a force to said lever sections for bringing said lever sections into said fully stretched out position, thereby causing an unfolding of said antenna reflector.

2. The apparatus of claim 1, further comprising guide roller means for combining a plurality of cables provided for a respective plurality of lever means for actuating said plurlity of lever means in unison.

3. The apparatus of claim 1 or 2, wherein said ribs have radially outer ends, said lever means being pivoted to said ribs by said pivot means at a spacing radially inwardly from said radially outer rib ends.

4. The apparatus of claim 1, comprising further lever means (10, 11, 12, 13) also having buckling joints for folding the respective further lever means in but one direction, said buckling joints snapping into a locked position when the respective lever means is fully stretched out, said ribs having radially outer ends, and further pivot means pivoting ends of said further lever means to the radially outer ends of adjacent ribs.

5. The apparatus of claim 4, comprising pulling cable means (14, 15, 16) operatively connected to the buckling joints (10', 11', 12') of said further lever means (10, 11, 12) interconnecting said radially outer ends of said ribs for unfolding said reflector.

6. The apparatus of claim 4, further comprising cable guide means (27, 28, 29, 30) operatively connected to the buckling joints (10', 11', 12', 13') of said further lever means (10, 11, 12, 13) which interconnect said radially outer ends of said ribs, cable guide rollers (31, 32, 33, 34, 35) operatively connected to said radially outer rib ends, tensioning cable means (26) running through or over said cable guide means and said cable guide rollers for buckling said buckling joints radially outwardly by said tensioning cable means.

7. The apparatus of claim 6, wherein said cable guide means (27 to 30) guide the tensioning cable means radially outwardly whereas the cable guide rollers (31 to 35) guide the tensioning cable means radially inwardly.

8. The apparatus of claim 1, wherein said ribs form groups of three ribs each (2, 3, 4; 4, 5, 6), each of said lever means bridging a group of three ribs at a spacing radially inward from the radially outer rib ends, whereby the ends of the respective lever means are pivoted to the two outer ribs of a group of three ribs, said apparatus comprising further outer lever means (10, 11, 12, 13) pivoted to the ends of said three ribs of a group so that the radially outer end of an intermediate rib (3, 5) of a group is connected to the radially outer ends of the two outer ribs of a group by said further outer lever means.

9. The apparatus of claim 8, wherein said block and tackle means comprise first and second cables (14, 15) and first and second compensating sheaves (17, 18), said first cable (14) interconnecting the buckling joint (8') of a radially inner lever (8) with the buckling joint (10') of a radially outer lever (10) and running over said first compensating sheave (17), said second cable (15) being operatively connected to said first sheave (17) and to the buckling joint (11') of another radially outer toggle lever (11), said second cable running over said second compensating sheave (18).

10. The apparatus of claim 1, wherein said ribs comprise a central rib (2), three intermediate ribs (3, 4, 5) on each side of said central rib, and two closure ribs (6), each of said closure ribs being spaced from said central rib (2) outwardly of said intermediate ribs.

11. The apparatus of claim 10, wherein said lever means comprise four inner levers, two of which are arranged on each side of said central rib (2) and radially inwardly of the radially outer rib ends, so that both levers on each side of the central rib are pivoted to the middle rib (4) of said three intermediate ribs with one of their ends while the other end of one lever is pivoted to the central rib and the other end of the other lever is pivoted to the respective closure rib (6), said apparatus further comprising radially outer levers (10, 11, 12, 13) and further pivot means for pivotally interconnecting the radially outer ends of all of said ribs by said radially outer levers.

12. The apparatus of claim 11, wherein said block and tackle means comprise a set of five cables (14, 15, 16, 20, 22) on each side of said central rib and a set of four guide sheaves (17, 18, 19, 21) on each side of said central rib (2), a first cable (14 running from a first buckling joint (10'), as counted away from said central rib (2), of a first toggle lever (10) of said further radially outer levers to the buckling joint (8') of a first radially inner lever (8) and over a first guide sheave (17), a second cable (15) running from a second buckling joint (11') to the first guide sheave (17) over a second guide sheave (18), a third cable (16) running from a third buckling joint (12') to a second buckling joint (9') of a second radially inner lever (9) over a third guide sheave (19), a fourth cable (20) running from the second guide sheave (18) to the third guide sheave (19) over a fourth guide sheave (21), said apparatus further comprising tension cable take-up means, and wherein a fifth cable (22) runs from said fourth guide sheave (21) to said cable take-up means.

13. The apparatus of claim 10, wherein said block and tackle means comprise on each side of said central rib (2) a set of three cables and a plurality of guide sheaves, said apparatus further comprising radially outer toggle levers (10, 11, 12, 13) pivoted to the radially outer ends of said ribs and having respective radially outwardly yielding buckling joints, a first cable of said set running from the buckling joint (8') of one of said first mentioned toggle lever means (8) to the buckling joint (9') of the other of said first mentioned toggle lever means over a first guide sheave (24), said guider sheaves further including a guide roller at each radially outer end of said ribs, said apparatus further comprising cable guide members (27, 28, 29, 30) located at each buckling joint of said radially outwardly yielding buckling joints, a second cable (26) of said set running over all of said guide rollers at each radially outer end of said ribs and over or through said cable guide members, whereby the second cable (26) is guided radially outwardly by said cable guide members and by said guide rollers radially inwardly, said apparatus further comprising cable take-up means (36, 37), a third cable running from said first guide sheave to said take-up means and said second cable running from the last guide roller to said take-up means for buckling all toggle levers radially outwardly.

14. The apparatus of claim 13, wherein said take-up means comprise separate cable winding means for said second and third cables.

* * * * *

UNITED STATES PATENT AND TRADEMARK OFFICE

CERTIFICATE OF CORRECTION

PATENT NO. : 4,498,087

DATED : February 5, 1985

INVENTOR(S) : Herbert Imbiel, Henning Herbig

It is certified that error appears in the above—identified patent and that said Letters Patent is hereby corrected as shown below:

Claim 2, line 4, (column 6, line 11) replace "plurlity" by --plurality--.

Claim 9, line 9, (column 6, line 63) delete "toggle".

Claim 12, line 7, (column 7, line 22) delete "toggle".

Claim 13, line 4, (column 8, line 7) delete "toggle";

line 9, (column 8, line 12) delete "toggle";

line 10, (column 8, line 13) delete "toggle";

line 11, (column 8, line 14) replace "guider" by --guide--;

line 25, (column 8, line 28) delete "toggle".

Signed and Sealed this

Ninth Day of July 1985

[SEAL]

*Attest:*

DONALD J. QUIGG

*Attesting Officer*

*Acting Commissioner of Patents and Trademarks*